United States Patent [19]

Löwenstein et al.

[11] Patent Number: 4,654,153

[45] Date of Patent: Mar. 31, 1987

[54] SPINNING PREPARATIONS FOR MELT SPINNING SYNTHETIC FIBERS

[75] Inventors: Albert Löwenstein, Haan; Heidi Fiedler, Korschenbroich-Liedberg, both of Fed. Rep. of Germany

[73] Assignee: Henkel Kommanditgesellschaft auf Aktien, Dusseldorf, Fed. Rep. of Germany

[21] Appl. No.: 681,707

[22] Filed: Dec. 13, 1984

[30] Foreign Application Priority Data

Jan. 23, 1984 [DE] Fed. Rep. of Germany ..... 3402155

[51] Int. Cl.[4] ..... D06M 9/00

[52] U.S. Cl. ..... 252/8.9; 252/8.6; 252/8.7

[58] Field of Search ..... 252/8.6, 8.7, 8.9

[56] References Cited

U.S. PATENT DOCUMENTS

| | | | |
|---|---|---|---|
| 4,348,517 | 9/1982 | Chakravarti | 252/8.9 |
| 4,356,219 | 10/1982 | Boon et al. | 252/8.9 |
| 4,371,658 | 2/1983 | Marshall et al. | 252/8.9 |
| 4,387,069 | 6/1983 | Murase | 252/8.9 |
| 4,403,049 | 9/1983 | Murase et al. | 252/8.9 |
| 4,517,245 | 5/1985 | Spain | 252/8.9 |

FOREIGN PATENT DOCUMENTS

| | | | |
|---|---|---|---|
| 2833600 | 2/1979 | Fed. Rep. of Germany | 252/8.9 |
| 0150913 | 9/1981 | Fed. Rep. of Germany | 252/8.9 |
| 0748566 | 9/1970 | Japan | 252/8.9 |
| 0025893 | 3/1975 | Japan | 252/8.9 |
| 0034100 | 3/1977 | Japan | 252/8.9 |
| 0031898 | 3/1978 | Japan | 252/8.9 |
| 0065067 | 4/1983 | Japan | 252/8.9 |

*Primary Examiner*—Joseph L. Schofer
*Assistant Examiner*—J. M. Reddick
*Attorney, Agent, or Firm*—Ernest G. Szoke; Henry E. Millson, Jr.; Mark A. Greenfield

[57] ABSTRACT

A spinning preparation, for the melt spinning of synthetic fibers, containing a smoothing agent, an emulsifier, a wetting agent, an antistatic agent, and an epoxidized compound containing at least 8 carbon atoms to produce a cohesion promoting effect on the fibers.

6 Claims, No Drawings

SPINNING PREPARATIONS FOR MELT SPINNING SYNTHETIC FIBERS

BACKGROUND OF THE INVENTION

1. Field of the Invention

The present invention relates to spinning preparations and processes for the melt spinning of synthetic fibers.

2. Description of the Related Art

In the melt spinning of synthetic fibers and their further processing into textile or industrial yarns, the multifilament yarns are wound without twisting onto spinning bobbins. The individual capillaries are in the form of bundles of parallel filaments, being held together solely by the more or less clearly pronounced adhesion effect of the spinning preparation. In the subsequent drawing process, the yarns are normally given a protective twist of a few turns per meter. However, this protective twist is not sufficient for many subsequent processing operations. Accordingly, the filaments either have to be twisted or protected by coating with a film of size in a separate process step. Both twisting and also sizing are expensive additional process steps. Accordingly, investigations have long been made to find alternatives for improving the inter-filament cohesion of the yarns to such an extent as to make these process steps superfluous.

The spinning preparations used in the past contain as filament cohesion promoters such additives as sarcosides or polymers of relatively high viscosity, such as polyisobutylene. Depending on the concentration in which they are used, compounds such as these are capable of improving the cohesion-promoting effect of spinning preparations by increasing the adhesion forces between the individual capillaries. However, the cohesion effect obtained in this way is only temporary because the additives in question are washed out again during the first wet process, for example in the dyeing operation. Another disadvantage attending many of these cohesion promoters lies in their inadequate thermal stability. This seriously restricts their use for spinning preparations which are intended for texturing or for industrial yarns which have to be subjected to high-temperature drawing.

DESCRIPTION OF THE INVENTION

The present invention relates to spinning preparations for the melt-spinning of synthetic fibers which contain smoothing agents, emulsifiers, wetting agents, antistatic agents and, optionally, other additives, and which contain from about 1 to about 30% by weight of at least one epoxidized compound having at least 8 carbon atoms. The present invention also relates to a process for obtaining permanent inter-filament cohesion in the melt-spinning of synthetic fibers in which the above spinning preparation is applied to the fibers in a quantity of from about 0.3 to about 2.0% by weight followed by heating to a temperature in the range of from about 150 to about 250° C. The epoxidized compounds having at least 8 carbon atoms referred to above are derived from one or more of the following:

a. A $C_8$–$C_{24}$ mono- or di-olefinically unsaturated fatty acid. Preferably, from 12 to 18 carbon atoms are present therein.

b. A $C_8$–$C_{24}$ mono- or di-olefinically unsaturated fatty alcohol. Preferably from 12 to 18 carbon atoms are present therein.

c. A $C_1$–$C_3$ alkyl ester of a $C_8$–$C_{24}$ mono- or di-olefinically unsaturated fatty acid. Preferably, the fatty acid portion thereof contains from 12 to 18 carbon atoms. The methyl ester is preferred although the ethyl and propyl esters can also be employed.

d. A glyceride of a $C_8$–$C_{24}$ mono- or di-olefinically unsaturated fatty acid. Preferably, the fatty acid portion contains from 12 to 18 carbon atoms. The glyceride can be a mono-, di- or triglyceride.

e. A $C_8$–$C_{24}$ mono- or di-olefin, preferably containing from 12 to 18 carbon atoms.

The introduction of one or more epoxide groups is carried out in known manner, for example by reacting the above compounds with hydrogen peroxide in the presence of formic acid. The above compounds are preferably substantially fully epoxidized, although compounds that contain at least one epoxy group and contain remaining unsaturation can also be used herein. Preferred compounds for use herein are the fully epoxidized products of unsaturated $C_{12}$–$C_{18}$ fatty acids, unsaturated $C_{12}$–$C_{18}$-fatty alcohols, and $C_1$–$C_3$ esters of unsaturated $C_{12}$–$C_{18}$ fatty acids, for example, unsaturated $C_{12}$–$C_{18}$ fatty acid methyl esters, or unsaturated $C_{12}$–$C_{18}$ fatty acid triglycerides, and $C_{12}$–$C_{18}$-olefins. Specific examples of suitable products are the epoxidation products of oleic acid methyl ester, soya oil fatty acid methyl ester, soya oil, mixtures of unsaturated $C_{12}$–$C_{18}$-fatty alcohols, 1,2-hexadecene and the like.

The spinning preparations of the invention have the following composition:

1. from about 35 to about 60% by weight of one or more smoothing agents,
2. from about 1 to about 30%, preferably about 8 to about 20%, and more preferably from about 5 to about 15% by weight of at least one epoxidized compound of the invention,
3. from about 30 to about 45% by weight of emulsifiers, wetting agents, and antistatic agents, and
4. any balance, water.

The above spinning preparations are applied in the usual way immediately after the melt-spinning process. They are applied in the form of an aqueous emulsion, e.g. from about 10 to about 25% by weight aqueous emulsions, or in the form of solutions in organic solvents, for example in white spirit, or even in undiluted form providing the viscosity of the concentrated preparation is suitable for application. The quantity applied amounts to between about 0.3 and about 2.0% by weight, expressed as total active substances (i.e. ingredients other than water). The preparation is applied by means of applicator rolls or by means of metering pumps in conjunction with suitable applicators.

Smoothing agents include mineral oils, fatty acid esters, alkylene oxide adducts, and polymers, and are well known in this art. Suitable emulsifiers, wetting agents and antistatic agents include anionic and nonionic surfactants, such as ethylene oxide adducts with higher fatty alcohols, alkyl phenols or other solids, triethanolamine soaps, alkane sulfonates, phosphoric acid esters and the like. After the spinning preparations have been applied, the treated filaments are heat-treated at temperatures in the range of from about 150° to about 250° C., and preferably at temperatures in the range of from about 150° to about 230° C. This thermal after-treatment, which is carried out for from about 0,1 to about 5 seconds, is essential to the onset of the cohesion-promoting effect, and can be carried out immediately after application of the spinning preparation of the invention, or even at a later stage in a separate operation. The present spinning preparations show adequate stability for prolonged periods at normal ambient or storage temperatures. The process of the invention is suitable for obtaining a permanent, temperature-resistant and washing-resistant cohesion-promoting effect in the production of textile yarns, industrial yarns or bulked continuous filament yarns from polyamide (PA), polyester (PES) or polyolefin, for example polypropylene (PP). Apart from the heat treatment, no changes need to be made to the standard procedure.

The invention will be illustrated but not limited by the following examples.

The spinning preparations set forth below were applied in the form of 10–25% by weight aqueous emulsions to various fibers immediately after melt spinning. The preparations were applied by applicator rolls in a quantity of from 0.5 to 1.3% by weight, based on anhydrous preparation. After application, thermal fixing was carried out by heating to 150°–230° C. The preparation of Example 7 did not contain an epoxide compound and was used for comparison. The cohesion-promoting effect was tested as follows:

The filament to be tested was clamped vertically into a holder. The filament had a total length of 50 cm. At its lower end, the filament was loaded by a weight of 5.7 g/tex. The filament was cut with sharp scissors at a length of 40 cm. As a result of the sudden. relaxation, the free end of the filament splits open into individual capillaries to a greater or lesser extent, depending upon the cohesion-promoting effect of the preparation. The proportion of unsplit filament in the overall length of the filament was evaluated as a percentage, the test value being represented by the average value of 20 individual measurements (literature: R. Buttner, R. Schrot, Textiltechnik 29 (1979) 4, Page 223).

EXAMPLE 1

50% of i-tridecylstearate
10% of soya oil methyl ester epoxide
14% of hardened castor oil +25 EO
11% of coconut oil fatty alcohol +6 EO
9% of oleic acid mono -/diglyceride
6% of petroleum sulfonate, Na-salt

EXAMPLE 2

40% of trimethylol propane tripelargonic acid ester
15% of epoxy stearic acid methyl ester
13% of oleyl alcohol +5 EO
13% of petroleum sulfonate, Na-salt
7% of hardened castor oil +25 EO
9% of triethanolamine oleate
3% of water

EXAMPLE 3

50% of EO/PO-copolymer, MW 1500, EO/PO-ratio 5:7
15% of soya oil methyl ester epoxide
25% of nonyl phenol +10 EO
10% of hardened castor oil +25 EO

EXAMPLE 4

50% of EO/PO-copolymer, MW 2000, EO/PO-ratio 1:1
10% of $C_{12}$–$C_{18}$-epoxy fatty alcohol mixture
20% of nonyl phenol +15 EO
20% of hardened castor oil +25 EO

EXAMPLE 5

50% of hexadecylstearate
10% of soya oil epoxide
10% of oleic acid mono-/diglyceride
10% of $C_{12}$–$C_{14}$ fatty alcohol +5 EO
15% of $C_{12}$–$C_{18}$-fatty alcohol +6 EO mono-/diphosphoric acid ester, K-salt
5% of hardened castor oil +25 EO

EXAMPLE 6

50% of EO/PO-copolymer, MW 2000, EO/PO-ratio 1:1
20% of epoxy-1,2-hexadecane
20% of nonyl phenol +6.5 EO
10% of nonyl phenol +15 EO

EXAMPLE 7 (Comparison Example)

45% of trimethylol propane tripelargonic acid ester
20% of oleyl alcohol +5 EO
14% of petroleum sulfonate, Na-salt
7% of hardened castor oil +25 EO
10% of triethanolamine oleate
4% of water The results of the cohesion tests are set forth in Table 1 below.

TABLE 1

| Spinning preparation | % Applied | Fiber | Fixing Temperature (°C.) | % Cohesion |
|---|---|---|---|---|
| Example 1 | 0.9 | Nylon 6, 1100 dtex f 210 | 180 | 92 |
| Example 2 | 1.1 | PES, 1250 dtex f 220 | 230 | 93 |
| Example 3 | 0.5 | PES, 167 dtex f 34 | 160 | 95 |
| Example 4 | 1.2 | PP, 1200 dtex f 68 | 150 | 90 |
| Example 5 | 0.5 | Nylon 66, 44 dtex f 13 | 180 | 88 |
| Example 6 | 1.3 | PP, 2200 dtex f 204 | 150 | 90 |
| Example 7 (Comparison Example) | 1.1 | PES, 1250 dtex f 220 | | 26 |

What is claimed is:

1. In a spinning preparation for the melt spinning of synthetic fibers in which the spinning preparation contains a smoothing agent, an emulsifier, a wetting agent and an antistatic agent, the improvement comprising wherein from about 1 to about 30% by weight of at least one epoxidized compound is present in said spinning preparation, said epoxidized compound being selected from the group consisting of:

a. a $C_8$–$C_{24}$ mono- or di-olefinically unsaturated fatty acid;
b. a $C_8$–$C_{24}$ mono- or di-olefinically unsaturated fatty alcohol;
c. a $C_1$–$C_3$ alkyl ester of a $C_8$–$C_{24}$ mono- or di-olefinically unsaturated fatty acid;
d. a glyceride of a $C_8$–$C_{24}$ mono- or di-olefinically unsaturated fatty acid; and
e. a $C_8$–$C_{24}$ mono- or di-olefin.

2. A spinning preparation in accordance with claim 1 wherein from about 5 to about 15% by weight of said epoxidized compound is present therein.

3. A spinning preparation in accordance with claim 1 wherein the $C_8$–$C_{24}$ groups or compounds are $C_{12}$–$C_{18}$ groups or compounds.

4. A spinning preparation in accordance with claim 1 wherein the olefin double bonds in the epoxidized compound are substantially fully epoxidized.

5. A spinning preparation in accordance with claim 1 wherein the epoxidized compound is one or more of the epoxidation products of oleic acid methyl ester, soya oil fatty acid methyl ester, soya oil, a mixture of $C_{12}$–$C_{18}$ fatty alcohols, and 1,2-hexadecene.

6. A spinning preparation in accordance with claim 1 wherein from about 35 to about 60% by weight of smoothing agent, from about 8 to about 20% by weight of the epoxidized compound, and from about 30 to 45% by weight of a combination of emulsifier, wetting agent, and antistatic agent, with any remainder water, are present therein.

* * * * *